US008872713B1

(12) United States Patent
Buckley et al.

(10) Patent No.: US 8,872,713 B1
(45) Date of Patent: Oct. 28, 2014

(54) DUAL-POLARIZED ENVIRONMENTALLY-HARDENED LOW PROFILE RADIATING ELEMENT

(75) Inventors: Michael J. Buckley, Marion, IA (US); Brian J. Herting, Marion, IA (US); John C. Mather, Cedar Rapids, IA (US); Wajih A. El Sallal, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 1010 days.

(21) Appl. No.: 12/764,338

(22) Filed: Apr. 21, 2010

(51) Int. Cl.
*H01Q 13/10* (2006.01)

(52) U.S. Cl.
USPC ..... 343/767

(58) Field of Classification Search
USPC ..... 343/767
See application file for complete search history.

(56) References Cited

U.S. PATENT DOCUMENTS

| | | | | |
|---|---|---|---|---|
| 2,771,606 | A * | 11/1956 | Kandoian | 343/890 |
| 4,710,775 | A * | 12/1987 | Coe | 343/727 |
| 7,170,446 | B1 * | 1/2007 | West et al. | 342/372 |
| 2005/0146479 | A1 * | 7/2005 | Stenger et al. | 343/772 |
| 2006/0017621 | A1 * | 1/2006 | Okawara et al. | 343/700 MS |
| 2010/0109966 | A1 * | 5/2010 | Mateychuk et al. | 343/841 |

* cited by examiner

*Primary Examiner* — Graham Smith
(74) *Attorney, Agent, or Firm* — Angel N. Gerdzhikov; Donna P. Suchy; Daniel M. Barbieri

(57) ABSTRACT

The present invention is directed to a radiating element assembly including radiating element integrated with a radome. The radiating element assembly may be dual-polarized. Further, the radiating element assembly may operate over a frequency band of 10.9 GHz-14.5 GHz and may be configured for minimizing polarization cross-talk at Array Normal Scan of well below −30 decibels over the entire frequency band. Still further, the radiating element assembly may provide return loss at Array Normal Scan of less than or equal to −10 dB.

10 Claims, 6 Drawing Sheets

DUAL-POLARIZED ENVIRONMENTALLY-HARDENED LOW PROFILE RADIATING ELEMENT

FIELD OF THE INVENTION

The present invention relates to the field of antennas and more particularly to a dual-polarized environmentally-hardened low profile radiating element.

BACKGROUND OF THE INVENTION

A number of currently available radiating elements may not provide a desired level of performance over a desired bandwidth range (ex.—over a broad bandwidth). For example, currently available radiating elements may suffer a poor match in return loss over a given frequency band, and/or may not provide a desired level of cross-coupling performance over a given frequency band.

Thus, it would be desirable to have a radiating element which addresses the problems associated with currently available solutions.

SUMMARY OF THE INVENTION

Accordingly an embodiment of the present invention is directed to a radiating element, including: a ground plane layer, the ground plane layer having a first slot and a second slot formed therethrough; a stripline feed layer, the stripline feed layer configured for being connected to the ground plane layer, the stripline feed layer including a first stripline feed, a second stripline feed, the first stripline feed configured for being connected to a vertical transition to feed a stripline manifold, the second stripline feed configured for being connected to a vertical transition to feed a stripline manifold, the first stripline feed and the second stripline feed being configured for providing electromagnetic energy to the ground plane layer, wherein the electromagnetic energy is radiated via at least one of the first slot and the second slot of the ground plane layer; a metamaterial layer, the metamaterial layer configured for being connected to the ground plane layer, the metamaterial layer including a metamaterial, and a dipole layer, the dipole layer configured for being connected to the metamaterial layer, the dipole layer including a plurality of dipoles.

A further embodiment of the present invention is directed to a radiating element assembly, including: a radome; and a radiating element, the radiating element configured for being connected to the radome, the radiating element including: a ground plane layer, the ground plane layer having a vertical polarization slot and a horizontal polarization slot formed therethrough; a stripline feed layer, the stripline feed layer configured for being connected to the ground plane layer, the stripline feed layer having a plurality of vias formed therethrough, said vias being configured for promoting elimination of resonances in the stripline feed layer, the stripline feed layer including a horizontal polarization feed, a vertical polarization feed, the horizontal polarization feed configured for being connected to a vertical transition to feed a stripline manifold, the vertical polarization feed configured for being connected to a vertical transition to feed a stripline manifold, the horizontal polarization feed and the vertical polarization feed being configured for providing electromagnetic energy to the ground plane layer; a metamaterial layer, the metamaterial layer configured for being connected to the ground plane layer, the metamaterial layer including a metamaterial; and a dipole layer, the dipole layer configured for being between the metamaterial layer and the radome, the dipole layer including a plurality of dipoles, wherein the electromagnetic energy is radiated via at least one of the vertical polarization slot and the horizontal polarization slot of the ground plane layer and traverses through the metamaterial layer, through the dipole layer and through the radome.

A still further embodiment of the present invention is directed to a radiating element assembly, including: a radome; and a radiating element, the radiating element configured for being connected to the radome, the radiating element including: a ground plane layer, the ground plane layer having a horizontal polarization slot and a vertical polarization slot formed therethrough; a plurality of stripline feed layers, each stripline feed layer included in the plurality of stripline feed layers being configured for being connected to the ground plane layer, each stripline feed layer included in the plurality of stripline feed layers having a plurality of vias formed therethrough, said vias being configured for promoting elimination of resonances in the stripline feed layer, each stripline feed layer including a horizontal polarization feed, a vertical polarization feed, the horizontal polarization feed configured for being connected to a vertical transition to feed a stripline manifold, the vertical polarization feed configured for being connected to a vertical transition to feed a stripline manifold, the horizontal polarization feed and the vertical polarization feed being configured for providing electromagnetic energy to the ground plane layer, wherein electromagnetic energy provided by the horizontal polarization feed is radiated via the horizontal polarization slot in a horizontally-polarized radiation pattern and electromagnetic energy provided by the vertical polarization feed is radiated via the vertical polarization slot in a vertically-polarized radiation pattern; a metamaterial layer, the metamaterial layer configured for being connected to the ground plane layer, the metamaterial layer including a metamaterial, the metamaterial being configured for promoting stability of impedance matching over an operating frequency band of the radiating element assembly; and a plurality of dipole layers, a first dipole layer included in the plurality of dipole layers being configured for being connected to the metamaterial layer, a second dipole layer included in the plurality of dipole layers being connected to the first dipole layer and the radome, each dipole layer including a plurality of horizontal polarization dipoles and a plurality of vertical polarization dipoles, the horizontal polarization dipoles and the vertical polarization dipoles being configured for promoting reflection matching for the radiating element and being further configured for canceling reflections from the ground plane slots, wherein electromagnetic energy radiated via the horizontal polarization slot and the vertical polarization slot of the ground plane layer traverses through the metamaterial layer, through the plurality of dipole layers and through the radome.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
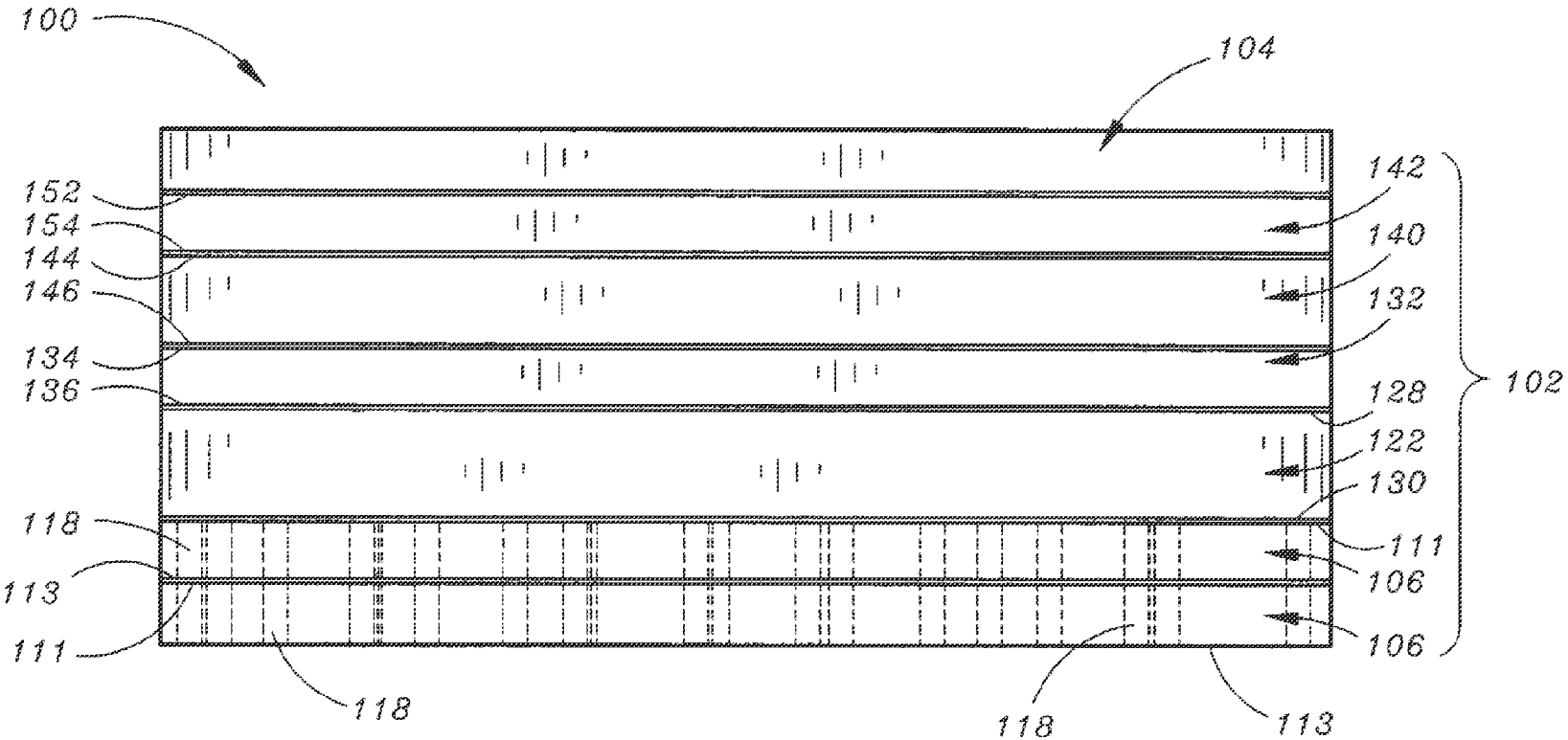
FIG. 1 is cross-sectional view of a dual-polarized radiating element assembly in accordance with an exemplary embodiment of the present invention.

Referring to FIG. 1, a radiating element assembly in accordance with an exemplary embodiment of the present invention is shown. In an exemplary embodiment of the present invention, the radiating element assembly 100 may include a radiating element 102. In further embodiments of the present invention, the radiating element assembly 100 may further include a radome 104. In current exemplary embodiments of the present invention, the radome 104 may be configured for being connected to (ex.—integrated with) the radiating element assembly. In further embodiments of the present invention, the radome 104 may be constructed of printed circuit board material(s), dielectric materials, laminate material(s) and/or bonding material(s) (ex.—Arlon CLTE™ core(s)). In still further embodiments of the present invention, the radome 104 may be configured to have a thickness of 20 mil (ex.—$^{20}/_{1000}$ inches thick).

In current exemplary embodiments of the present invention, the radiating element 102 may be configured for being integrated into a printed circuit board structure. In further embodiments of the present invention, the radiating element 102 may include one or more (ex.—two) stripline feed layers 106. In at least one exemplary embodiment of the present invention, the stripline feed layers 106 may be connected to each other (ex.—stacked upon each other) as shown in FIG. 1. In further embodiments of the present invention, each stripline feed layer 106 may be at least partially constructed of printed circuit board material(s), dielectric material(s), laminate material(s) and/or bonding material(s) (ex.—Arlon CLTE™ core(s)). In still further embodiments of the present invention, each stripline feed layer 106 may be configured to have a thickness of 20 mil.

Figure 2:
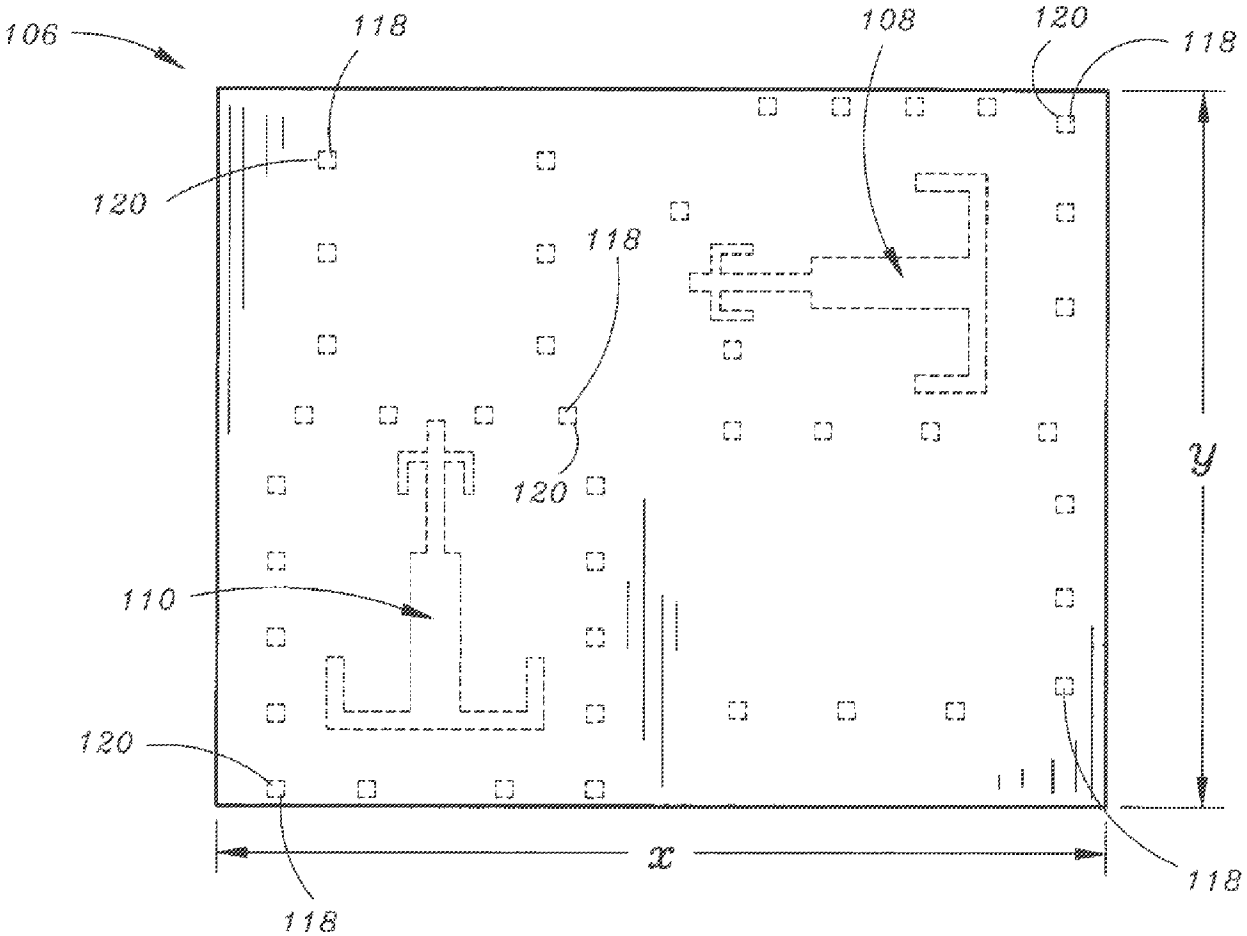
FIG. 2 is a top plan view of a stripline feed layer of the radiating element assembly shown in FIG. 1, in accordance with an exemplary embodiment of the present invention.

In exemplary embodiments of the present invention, the stripline feed layers 106 may be connected to each other via an adhesive material (ex.—Speedboard C® adhesive). In further embodiments of the present invention, each stripline feed layer 106 may include a first stripline feed 108 and a second stripline feed 110. In current exemplary embodiments of the present invention, the first stripline feed 108 may be configured for providing horizontal polarization for the radiating element assembly 100 (ex.—may be a horizontal polarization feed 108). In further embodiments of the present invention, the second stripline feed 110 may be configured for providing vertical polarization for the radiating element assembly 100 (ex.—may be a vertical polarization feed 110). In still further embodiments of the present invention, each stripline feed layer 106 may be configured as a rectangular grid having a top surface 111 and a bottom surface 113 (as shown in FIG. 1), further having a thickness (ex.—distance from top surface 111 to bottom surface 113) of 20 mil, and further having x and y axis dimensions (ex.—a footprint) of 0.60 free space wavelengths×0.48 free space wavelengths at an operating frequency of 14.5 Gigahertz (GHz) (as shown in FIG. 2). In further embodiments of the present invention, the top surface 111 of each stripline feed layer 106 may be oriented towards the radome 104, while the bottom surface 113 of each stripline feed layer 106 may be oriented away from the radome 104.

In current exemplary embodiments of the present invention, each stripline feed layer 106 may further include a first stripline feed 108 and a second stripline feed 110. In further embodiments of the present invention, each of the stripline feeds (108, 110) may be connected to a vertical transition to feed a stripline manifold. In still further embodiments of the present invention, each of the stripline feed layers 106 may be further configured with a plurality of channels or vias 118 which may be formed through the stripline feed layers 106 so as to vertically extend through the stripline feed layers 106 (ex.—through the top and bottom surfaces 111 and 113 of the stripline feed layers 106). In further embodiments of the present invention, the vertical vias 118 may be configured for eliminating resonances in the stripline feed layers 106. In additional exemplary embodiments of the present invention, a plurality of via fences 120 may be configured for being at least partially located within the vias 118. For example, each via fence 120 included in the plurality of via fences 120 may be a ring-shaped structure formed of protective material, which may be configured for being located (exs.—mounted or nested) within one of the vias 118 so as to at least partially protrude from the via above a surface (ex.—above a top surface 111) of the stripline feed layer 106 and to at least partially enclose (ex.—at least partially form a wall around) an opening of the via 118.

In current exemplary embodiments of the present invention, the radiating element assembly 100 may further include a ground plane layer 122 (ex.—a ground plane 122). In further embodiments of the present invention, the ground plane layer 122 may be connected to the stripline feed layers 106. For example, the ground plane layer 122 may be positioned (ex.—stacked) upon the stripline feed layers 106 as shown in FIG. 1. In exemplary embodiments of the present invention, the ground plane layer 122 may be configured with a plurality of slots. For instance, the ground plane layer 122 may include a first slot 124 and a second slot 126. In further embodiments of the present invention, the first slot 124 may be a vertical polarization slot and the second slot 126 may be a horizontal polarization slot. In still further embodiments of the present invention, when the ground plane layer 122 is connected to the stripline feed layers 106, the vertical polarization slot 124 may be positioned or located so as to be aligned with the vertical polarization feed 110, thereby allowing the vertical polarization feed 110 to provide electromagnetic energy which may be radiated in a vertically-polarized radiation pattern via the vertical polarization slot 124. In further embodiments, when the ground plane layer 122 is connected to the stripline feed layers 106, the horizontal polarization slot 126 may be positioned or located so as to be aligned with the horizontal polarization feed 108, thereby allowing the horizontal polarization feed 108 to provide electromagnetic energy which may be radiated in a horizontally-polarized radiation pattern via the horizontal polarization slot 126.

Figure 3:
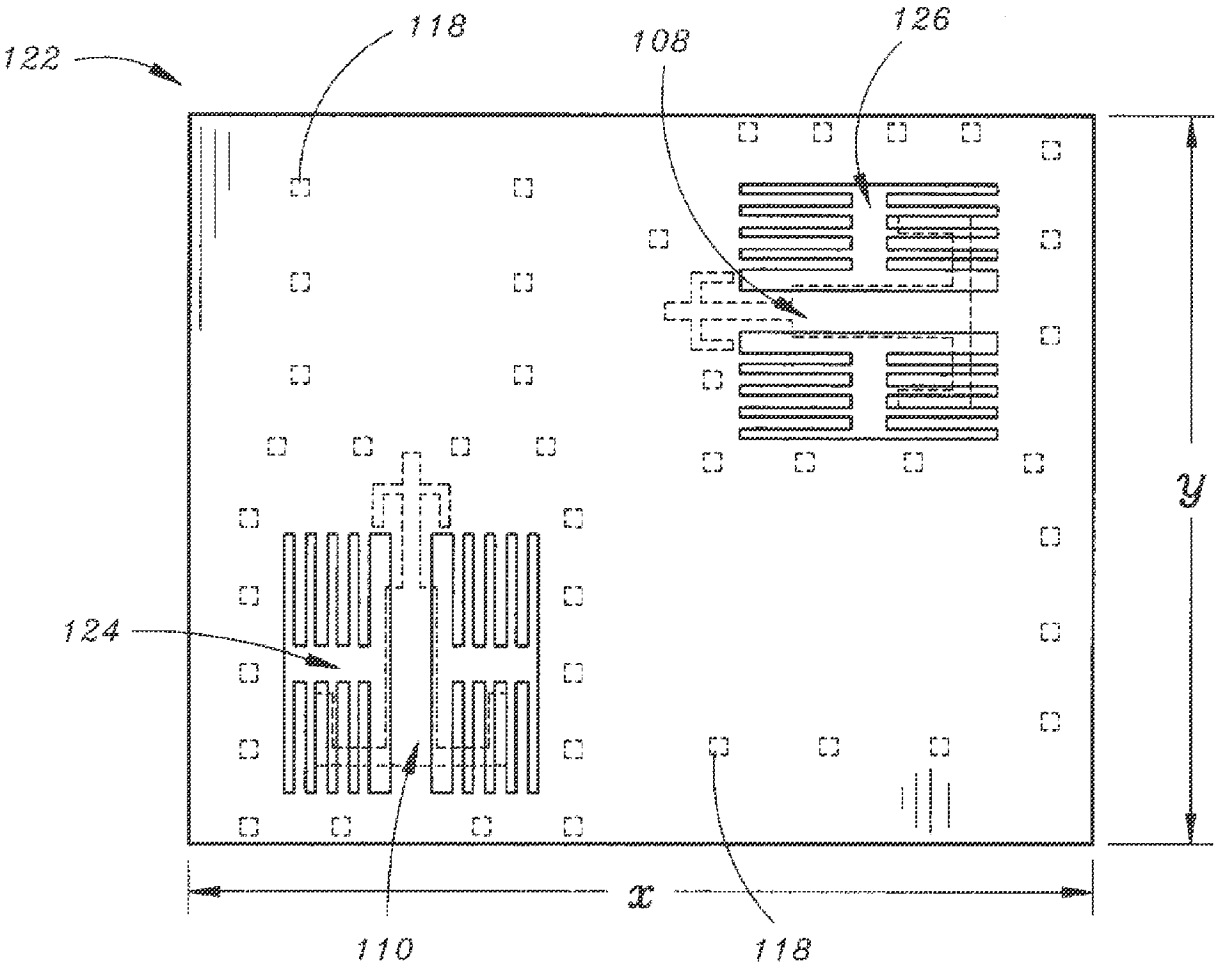
FIG. 3 is a top plan view of a ground plane layer of the radiating element assembly shown in FIG. 1, said ground plane layer being stacked/overlaid upon the stripline feed layer of FIG. 2, in accordance with an exemplary embodiment of the present invention.

In exemplary embodiments of the present invention, the ground plane layer 122 may be configured as a rectangular grid having a top surface 128 and a bottom surface 130 (as shown in FIGS. 1 and 3). When the ground plane layer is connected to the stripline feed layers 106, the top surface 128 of the ground plane layer 122 may be oriented towards the radome 104, while the bottom surface 130 may be oriented towards the stripline feed layers 106. In further embodiments of the present invention, the ground plane layer 122 may be configured to have a thickness (ex.—distance from top surface 128 to bottom surface 130) of 30 mil. In still further embodiments of the present invention, the ground plane layer 122 may have x and y axis dimensions (ex.—a footprint) of 0.60 free space wavelengths×0.48 free space wavelengths at an operating frequency of 14.5 Gigahertz (GHz) (as shown in FIG. 3). In further embodiments of the present invention, the ground plane layer 122 may be at least partially constructed of printed circuit board material(s), dielectric material(s), laminate material(s), and/or bonding material(s) (ex.—Arlon CLTE™ core).

Figure 4:
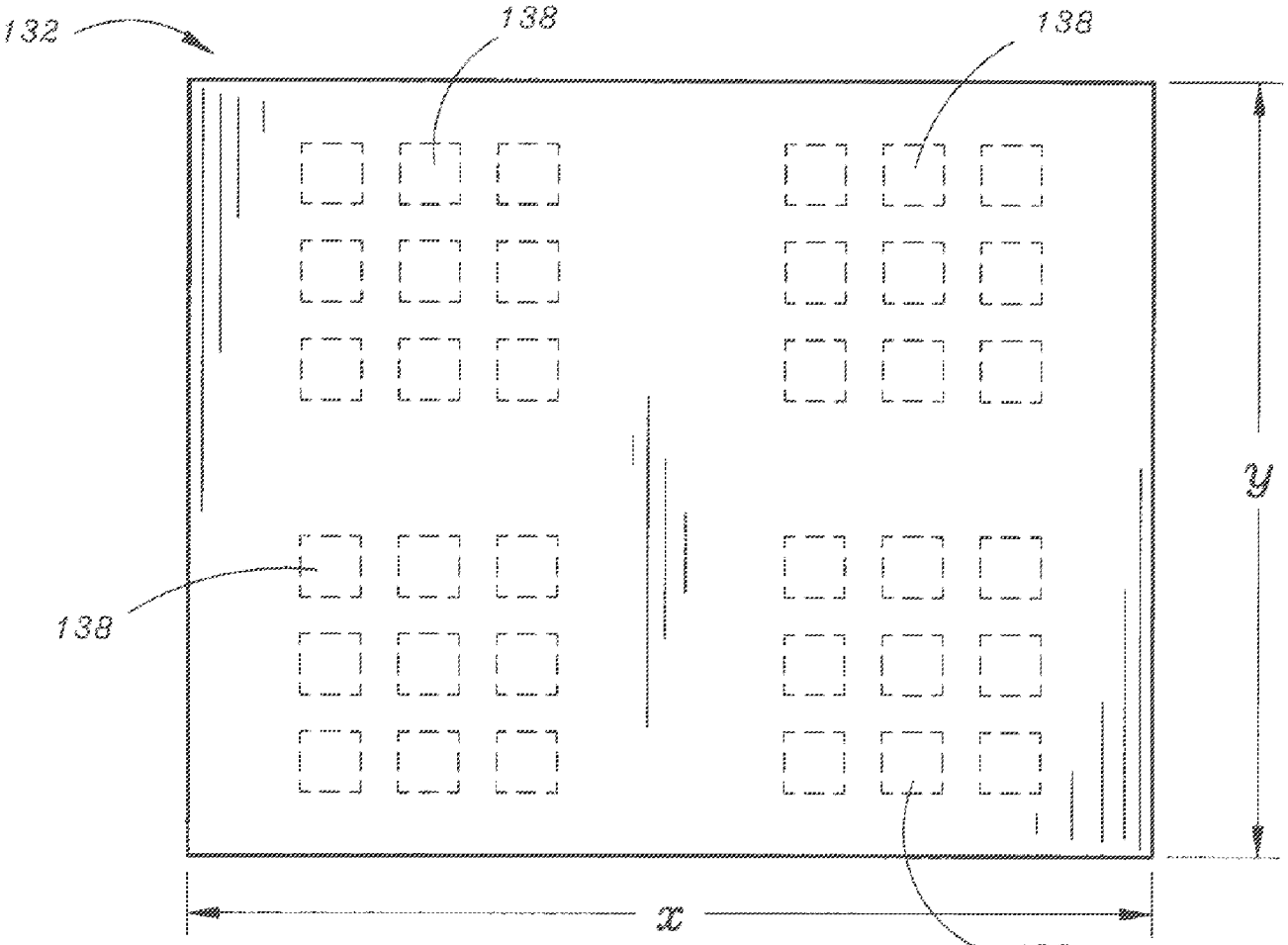
FIG. 4 is a top plan view of a metamaterial layer of the radiating element assembly shown in FIG. 1, in accordance with an exemplary embodiment of the present invention.

In current exemplary embodiments of the present invention, the radiating element assembly 100 may further include a metamaterial layer 132. In further embodiments of the present invention, the metamaterial layer 132 may be configured as a rectangular grid having a top surface 134 and a bottom surface 136 (as shown in FIG. 1) and further having a thickness (ex.—distance from top surface 134 to bottom surface 136) of 20 mil, and further having x and y axis dimensions (ex.—a footprint) of 0.60 free space wavelengths×0.48 free space wavelengths at an operating frequency of 14.5 Gigahertz (GHz) (as shown in FIG. 4). In exemplary embodiments of the present invention, the metamaterial layer 132 may be at least partially constructed of printed circuit board material(s), dielectric material(s), laminate material(s) and/or bonding material(s) (ex.—Arlon CLTE™ core). In further embodiments of the present invention, the metamaterial layer 132 may include one or more metamaterial(s) 138 (ex.—copper) which may be etched (ex.—patterned) on a dielectric surface (ex.—the bottom surface 136 and/or top surface 134) of the metamaterial layer 132. In still further embodiments of the present invention, the radiating element 102 (and the radiating element assembly 100) may be configured for operating over a broad frequency band (ex.—10.9 Gigahertz (GHz) to 14.5 GHz) and the metamaterial(s) 138 may be any material(s) configured for promoting stability of impedance matching over the entire operating frequency band of the radiating element 102. In further embodiments of the present invention, the metamaterial(s) 138 may be configured for providing an electromagnetic boundary condition for defining a frequency of the structure formed by the volume occupied by the metamaterial(s) 138. In current embodiments of the present invention, the metamaterials 138 may be selected for establishing a distinct frequency or set of frequencies over which the radiating element 102 (and the radiating element assembly 100) may operate.

In exemplary embodiments of the present invention, the metamaterial layer 132 may be configured for being connected to the ground plane layer 122. When the metamaterial layer 132 is connected to (ex.—stacked upon) the ground plane layer 122, the top surface 134 of the metamaterial layer 132 may be oriented towards the radome 104, while the bottom surface 136 of the metamaterial layer 132 may be oriented towards the ground plane layer 122. In further embodiments of the present invention, the metamaterial(s) 138 may be configured on or within the metamaterial layer 132 at locations such that, when the metamaterial layer 132 is connected to (ex.—stacked upon) the ground plane layer 122, the locations of the metamaterial(s) 138 align (ex.—are symmetric) with the slots (124, 126) (ex.—feed points 124, 126) of the ground plane layer 122 and the stripline feeds (108, 110) of the stripline feed layers 106, thereby minimizing coupling between the horizontal polarization (ex.—x polarization) of the radiating element assembly 100 and the vertical polarization (ex.—y polarization) of the radiating element assembly 100.

Figure 5:
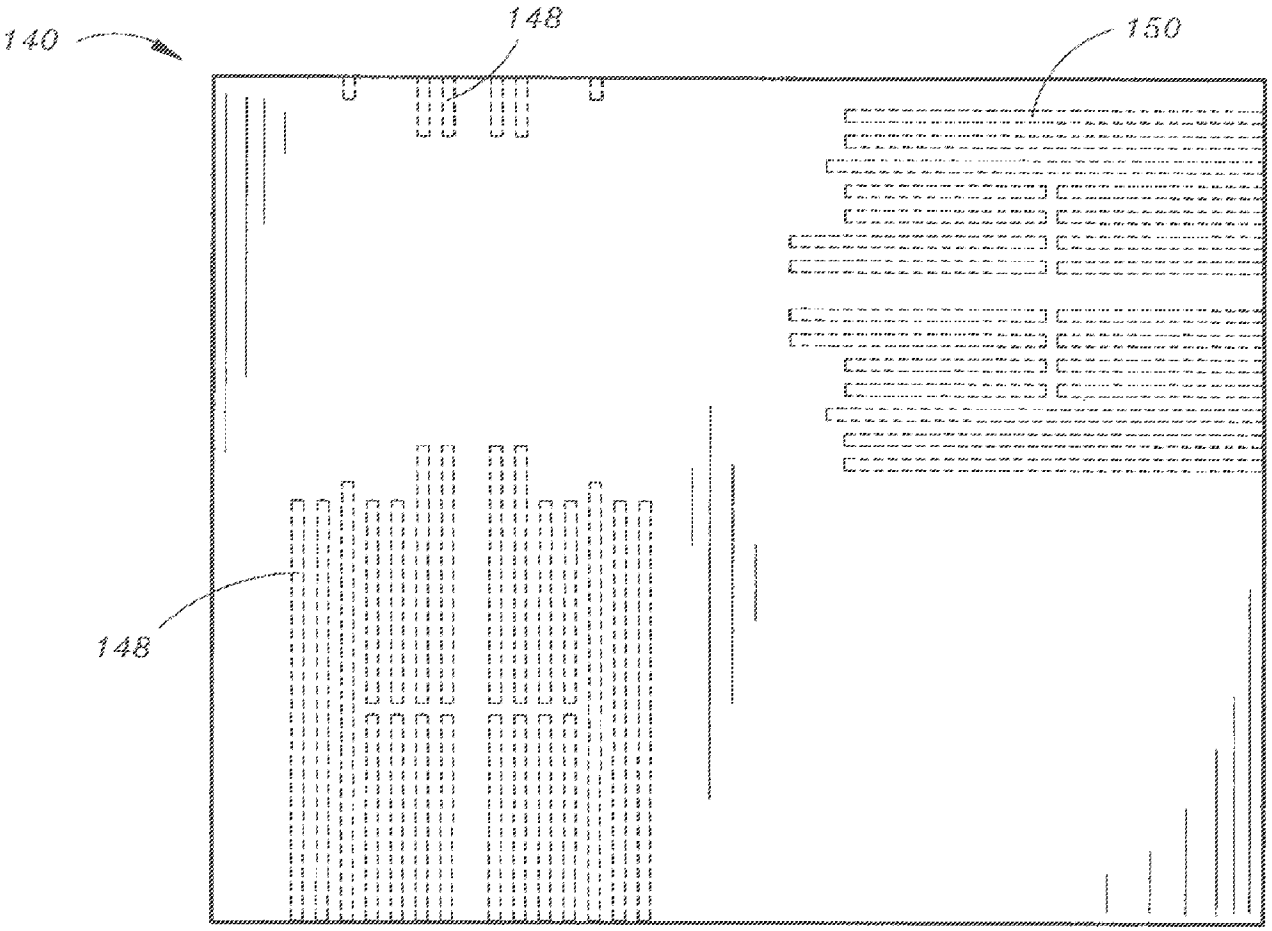
FIG. 5 is a top plan view of a lower dipole layer of the radiating element assembly shown in FIG. 1, in accordance with an exemplary embodiment of the present invention.

In current exemplary embodiments of the present invention, the radiating element assembly 100 may include one or more dipole layers, such as a first dipole layer (ex.—a lower dipole layer) 140 and a second dipole layer (ex.—an upper dipole layer) 142. In further embodiments of the present invention, the lower dipole layer 140 may be configured as a rectangular grid having a top surface 144 and a bottom surface 146 (as shown in FIG. 1) and further having a thickness (ex.—distance from top surface 144 to bottom surface 146) of 30 mil, and further having x and y axis dimensions (ex.—a footprint) of 0.60 free space wavelengths×0.48 free space wavelengths at an operating frequency of 14.5 Gigahertz (GHz). In exemplary embodiments of the present invention, the lower dipole layer 140 may be at least partially constructed of printed circuit board material(s), dielectric material(s), laminate material(s) and/or bonding material(s) (ex.—Arlon CLTE™ core). In further embodiments of the present invention, the lower dipole layer 140 may include a first plurality of dipoles (ex.—vertical polarization dipoles) 148 and a second plurality of dipoles (ex.—horizontal polarization dipoles) 150 (as shown in FIG. 5). The vertical polarization dipoles 148 and the horizontal polarization dipoles 150 may be materials (ex.—copper) which may be etched (ex.—patterned) on a dielectric surface (ex.—the bottom surface 146 and/or top surface 144) of the lower dipole layer 140. In still further embodiments of the present invention, the dipoles (148, 150) may be any material(s) configured for promoting reflection matching for the radiating element assembly 100 and for canceling reflections from the ground plane slots (124, 126).

In exemplary embodiments of the present invention, the lower dipole layer 140 is configured for being connected to the metamaterial layer 132. When the lower dipole layer 140 is connected to (ex.—stacked upon) the metamaterial layer 132, the top surface 144 of the lower dipole layer 140 may be oriented towards the radome 104, while the bottom surface 146 of the lower dipole layer 140 may be oriented towards the metamaterial layer 132. In further embodiments of the present invention, the vertical polarization dipoles 148 and the horizontal polarization dipoles 150 may be configured on or within the lower dipole layer 140 at locations such that, when the lower dipole layer 140 is connected to (ex.—stacked upon) the metamaterial layer 132, the locations of the vertical polarization dipoles 148 and the horizontal polarization dipoles 150 align with the respective vertical and horizontal polarization slots (124, 126) of the ground plane layer 122 and the respective vertical and horizontal stripline feeds (110, 108) of the stripline feed layers 106.

Figure 6:
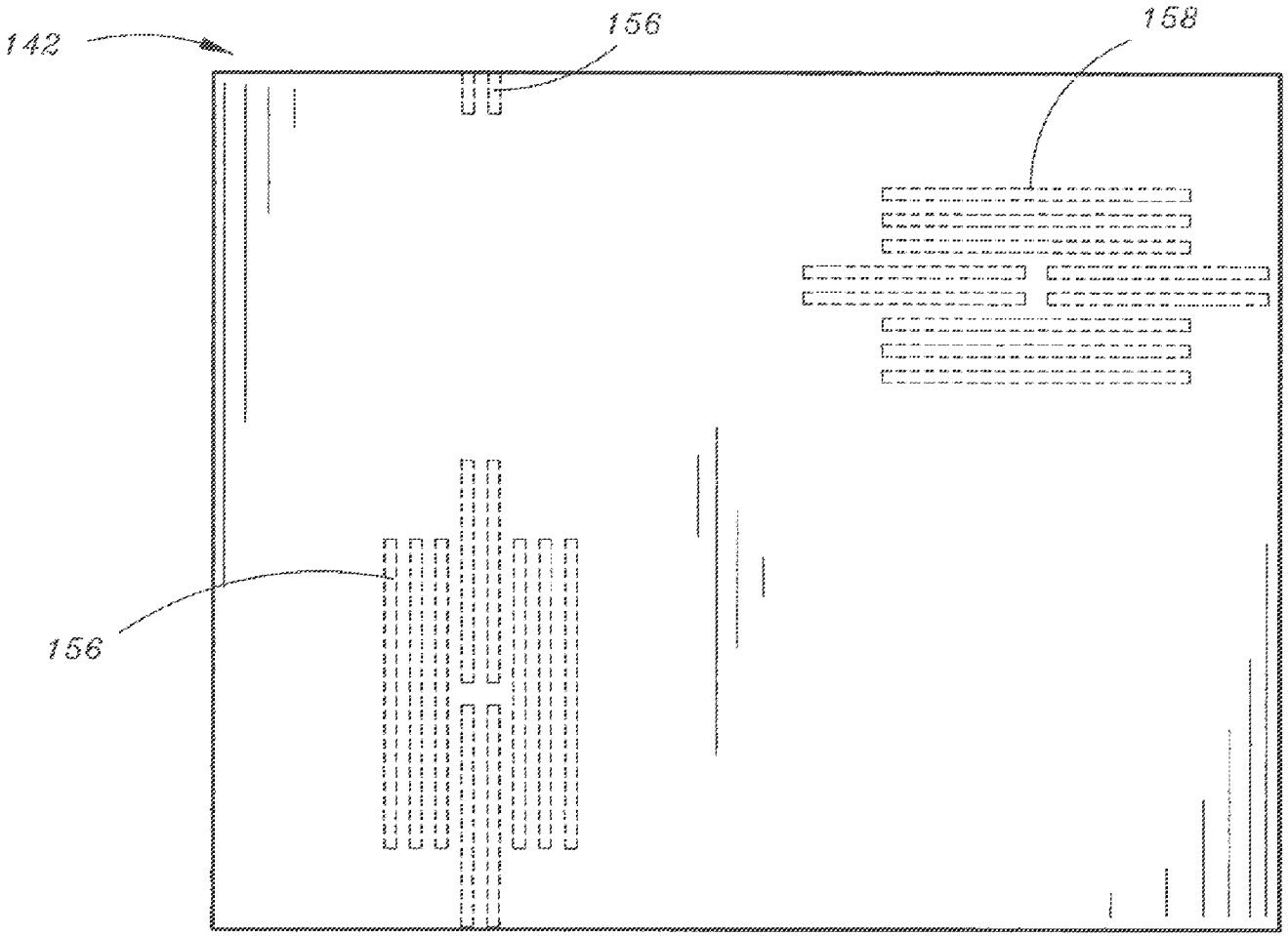
FIG. 6 is a top plan view of an upper dipole layer of the radiating element assembly shown in FIG. 1, in accordance with an exemplary embodiment of the present invention.

In further embodiments of the present invention, the upper dipole layer 142 may be configured as a rectangular grid having a top surface 152 and a bottom surface 154 (as shown in FIG. 1) and further having a thickness (ex.—distance from top surface 152 to bottom surface 154) of 20 mil, and further having x and y axis dimensions (ex.—a footprint) of 0.60 free space wavelengths×0.48 free space wavelengths at an operating frequency of 14.5 Gigahertz (GHz). In exemplary embodiments of the present invention, the upper dipole layer 142 may be at least partially constructed of printed circuit board material(s), dielectric material(s), laminate material(s) and/or bonding material(s) (ex.—Arlon CLTE™ core). In further embodiments of the present invention, the upper dipole layer 142 may include a first plurality of dipoles (ex.—vertical polarization dipoles) 156 and a second plurality of dipoles (ex.—horizontal polarization dipoles) 158 (as shown in FIG. 6). The vertical polarization dipoles 156 and the horizontal polarization dipoles 158 may be materials (ex.—copper) which may be etched (ex.—patterned) on a dielectric surface (ex.—the bottom surface 154 and/or top surface 152) of the upper dipole layer 142. In still further embodiments of the present invention, the dipoles (156, 158) may be any material(s) configured for promoting reflection matching for the radiating element assembly 100 and for canceling reflections from the ground plane slots (124, 126).

In exemplary embodiments of the present invention, the upper dipole layer 142 is configured for being connected to the lower dipole layer 140. When the upper dipole layer 142 is connected to (ex.—stacked upon) the lower dipole layer 140, the top surface 152 of the upper dipole layer 142 may be oriented towards and connected to the radome 104, while the bottom surface 154 of the upper dipole layer 142 may be oriented towards the lower dipole layer 140. In further embodiments of the present invention, the vertical polarization dipoles 156 and the horizontal polarization dipoles 158 may be configured on or within the upper dipole layer 142 at locations such that, when the upper dipole layer 142 is connected to (ex.—stacked upon) the lower dipole layer 140, the locations of the vertical polarization dipoles 156 and the horizontal polarization dipoles 158 of the upper dipole layer 142 align with the respective vertical and horizontal polarization slots (124, 126) of the ground plane layer 122 and the respective vertical and horizontal stripline feeds (110, 108) of the stripline feed layers 106.

As mentioned above, electromagnetic energy may be provided via the vertical and/or the horizontal polarization feeds (110, 108) and radiated via the vertical and/or horizontal polarization slots (124, 126) and via the layers (122, 132, 140 and 142) of the radiating element 102 and through the radome 104 of the radiating element assembly 100 in a vertically-polarized radiation pattern and/or a horizontally-polarized radiation pattern, thereby providing a dual-polarized radiating element 102 (and radiating element assembly 100).

In an exemplary embodiment of the present invention, the radiating element 102 (and radiating element assembly 100) may be configured for Array Normal scan. In further embodiments of the present invention, the radiating element 102 (and radiating element assembly 100) may be configured for minimizing polarization cross-talk (cross-coupling) at Array Normal Scan of well below −30 decibels (dB) (ex.—less than −25 dB) over an entire frequency band of operation of the radiating element 102 (ex.—10.9 GHz to 14.5 GHz). In current exemplary embodiments of the present invention, the radiating element 102 (and radiating element assembly 100) may be configured for providing return loss at Array Normal Scan of less than or equal to −10 dB. Thus, the radiating element 102 of the disclosed embodiments of the present invention meets very aggressive packaging, frequency band and cross-coupling requirements. In further embodiments of the present invention, the radiating element 102 (and radiating element assembly 100) may be configured for implementation in or use as a Military Satellite (MilSat) antenna (exs.—DataPath, GS). In alternative embodiments of the present invention, one or more of: the stripline feed layer(s) 106; the ground plane feed layer(s) 122; the metamaterial layer(s) 132; and the dipole layer(s) 140, 142 may be configured as grids having any one of a number of various shapes (ex.—square, circular, etc.) other than the rectangular grids described above.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A radiating element assembly, comprising:

a radome; and a radiating element, the radiating element configured for being connected to the radome, the radiating element including:

a ground plane layer, the ground plane layer having a vertical polarization slot and a horizontal polarization slot formed therethrough;

a stripline feed layer, the stripline feed layer configured for being connected to the ground plane layer, the stripline feed layer having a plurality of vias formed therethrough, said vias being configured for promoting elimination of resonances in the stripline feed layer, the stripline feed layer including a horizontal polarization feed, a vertical polarization feed, the horizontal polarization feed and the vertical polarization feed being configured for providing electromagnetic energy to the ground plane layer;

a metamaterial layer, the metamaterial layer located directly on the ground plane layer, the metamaterial layer including a metamaterial;

a first dipole layer, the first dipole layer being located directly on the metamaterial layer and between the metamaterial layer and the radome, the first dipole layer including a plurality of horizontal polarization dipoles and a plurality of vertical polarization dipoles; and a second dipole layer, the second dipole layer being stacked upon the first dipole layer and being located between the first dipole layer and the radome, the second dipole layer including a plurality of horizontal polarization dipoles and a plurality of vertical polarization dipoles, the plurality of horizontal polarization dipoles of the second dipole layer being at least partially aligned with the plurality of horizontal polarization dipoles of the first dipole layer and being at least partially aligned with the horizontal polarization slot of the ground plane layer, the plurality of vertical polarization dipoles of the second dipole layer being at least partially aligned with the plurality of vertical polarization dipoles of the first dipole layer and being at least partially aligned with the vertical polarization slot of the ground plane layer, wherein the electromagnetic energy is radiated via at least one of the vertical polarization slot and the horizontal polarization slot of the ground plane layer and traverses through the metamaterial layer, through the first dipole layer, through the second dipole layer, and through the radome.

2. A radiating element assembly as claimed in claim 1, wherein the metamaterial is configured for promoting stability of impedance matching over an operating frequency band of the radiating element.

3. A radiating element assembly as claimed in claim 1, wherein electromagnetic energy provided by the horizontal polarization feed is radiated via the horizontal polarization slot in a horizontally-polarized radiation pattern.

4. A radiating element assembly as claimed in claim 1, wherein electromagnetic energy provided by the vertical polarization feed is radiated via the vertical polarization slot in a vertically-polarized radiation pattern.

5. A radiating element assembly as claimed in claim 1, wherein the radiating element assembly is configured for minimizing polarization cross-talk at Array Normal Scan below −30 decibels over a frequency range of approximately 10.9 Gigahertz to 14.5 Gigahertz.

6. A radiating element assembly as claimed in claim 5, wherein the radiating element assembly is configured for providing return loss at Array Normal Scan of less than or equal to −10 dB.

7. A radiating element assembly, comprising:

a radome; and a radiating element, the radiating element configured for being connected to the radome, the radiating element including:

a ground plane layer, the ground plane layer having a horizontal polarization slot and a vertical polarization slot formed therethrough;

a plurality of stripline feed layers, each stripline feed layer included in the plurality of stripline feed layers being configured for being connected to the ground plane layer, each stripline feed layer included in the plurality of stripline feed layers having a plurality of vias formed therethrough, said vias being configured for promoting elimination of resonances in the stripline feed layer, each stripline feed layer including a horizontal polarization feed, a vertical polarization feed, the horizontal polarization feed configured for being connected to a vertical transition to a stripline manifold, the vertical polarization feed configured for being connected to a vertical transition to a stripline manifold, the horizontal polarization feed and the vertical polarization feed being configured for providing electromagnetic energy to the ground plane layer, wherein electromagnetic energy provided by the horizontal polarization feed is radiated via the horizontal polarization slot in a horizontally-polarized radiation pattern and electromagnetic energy provided by the vertical polarization feed is radiated via the vertical polarization slot in a vertically-polarized radiation pattern;

a metamaterial layer, the metamaterial layer configured for being connected to the ground plane layer, the metamaterial layer including a metamaterial, the metamaterial being configured for promoting stability of impedance matching over an operating frequency range of the radiating element assembly; and a plurality of dipole layers, a first dipole layer included in the plurality of dipole layers being configured for being connected to the metamaterial layer, a second dipole layer included in the plurality of dipole layers being connected to the first dipole layer and the radome, each dipole layer including a plurality of horizontal polarization dipoles and a plurality of vertical polarization dipoles, the horizontal polarization dipoles and the vertical polarization dipoles being configured for promoting reflection matching for the radiating element and being further configured for canceling reflections from the ground plane slots, wherein electromagnetic energy radiated via the horizontal polarization slot and the vertical polarization slot of the ground plane layer traverses through the metamaterial layer, through the plurality of dipole layers and through the radome.

8. A radiating element assembly as claimed in claim 7, wherein the metamaterial is copper.

9. A radiating element assembly as claimed in claim 7, wherein the radiating element assembly is configured for providing return loss at Array Normal Scan of less than or equal to −10 dB over a frequency range of approximately 10.9 Gigahertz to 14.5 Gigahertz.

10. A radiating element, comprising:

a ground plane layer, the ground plane layer having a horizontal polarization slot and a vertical polarization slot formed therethrough;

a plurality of stripline feed layers, each stripline feed layer included in the plurality of stripline feed layers being configured for being connected to the ground plane layer, each stripline feed layer included in the plurality of stripline feed layers having a plurality of vias formed therethrough, said vias being configured for promoting elimination of resonances in the stripline feed layer, each stripline feed layer including a horizontal polarization feed and a vertical polarization feed, the horizontal polarization feed configured for being connected to a vertical transition to a stripline manifold, the vertical polarization feed configured for being connected to a vertical transition to a stripline manifold, the horizontal polarization feed and the vertical polarization feed being configured for providing electromagnetic energy to the ground plane layer, wherein electromagnetic energy provided by the horizontal polarization feed is radiated via the horizontal polarization slot in a horizontally-polarized radiation pattern and electromagnetic energy provided by the vertical polarization feed is radiated via the vertical polarization slot in a vertically-polarized radiation pattern;

a metamaterial layer, the metamaterial layer configured for being connected to the ground plane layer, the metamaterial layer including a metamaterial, the metamaterial being configured for promoting stability of impedance matching over an operating frequency range of the radiating element assembly; and a plurality of dipole layers, a first dipole layer included in the plurality of dipole layers being configured for being connected to the metamaterial layer, a second dipole layer included in the plurality of dipole layers being connected to the first dipole layer and the radome, each dipole layer including a plurality of horizontal polarization dipoles and a plurality of vertical polarization dipoles, the horizontal polarization dipoles and the vertical polarization dipoles being configured for promoting reflection matching for the radiating element and being further configured for canceling reflections from the ground plane slots, wherein electromagnetic energy radiated via the horizontal polarization slot and the vertical polarization slot of the ground plane layer traverses through the metamaterial layer, through the plurality of dipole layers.

* * * * *